US006934993B1

(12) United States Patent
Huffman et al.

(10) Patent No.: US 6,934,993 B1
(45) Date of Patent: Aug. 30, 2005

(54) EXTRACTION CLEANING MACHINE WITH AGITATION BRUSHES

(75) Inventors: Eric C. Huffman, Lowell, MI (US); Gary A. Kasper, Grand Rapids, MI (US); Charles A. Reed, Rockford, MI (US); Eric J. Hansen, Ada, MI (US); Stefan G. Rider, Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 373 days.

(21) Appl. No.: 10/064,322

(22) Filed: Jul. 2, 2002

Related U.S. Application Data

(60) Provisional application No. 60/302,526, filed on Jul. 2, 2001.

(51) Int. Cl.[7] ..... A47L 9/04
(52) U.S. Cl. ..... 15/322; 15/371; 15/392
(58) Field of Search ..... 15/320–322, 383, 15/392, 389, 371, 372, 182, 382

(56) References Cited

U.S. PATENT DOCUMENTS

| | | | | | |
|---|---|---|---|---|---|
| 1,205,162 | A * | 11/1916 | Clements | 15/388 |
| 1,884,013 | A * | 10/1932 | Losey | 15/383 |
| 2,416,420 | A * | 2/1947 | Taylor | 15/372 |
| 2,659,921 | A * | 11/1953 | Osborn | 15/182 |
| 3,200,433 | A * | 8/1965 | Downey | 15/328 |
| 3,241,172 | A * | 3/1966 | Tilgner | 15/182 |
| 3,391,418 | A * | 7/1968 | Jonsson | 15/319 |
| 3,828,387 | A * | 8/1974 | Liebscher | 15/182 |
| 3,892,003 | A * | 7/1975 | Peabody | 15/52.1 |
| 4,662,027 | A * | 5/1987 | Parker et al. | 15/392 |
| 5,237,720 | A * | 8/1993 | Blase et al. | 15/321 |
| 5,367,740 | A * | 11/1994 | McCray | 15/320 |
| 5,802,664 | A * | 9/1998 | Mondigo et al. | 15/322 |
| 6,134,744 | A * | 10/2000 | Kasen et al. | 15/320 |
| 6,167,587 | B1 * | 1/2001 | Kasper et al. | 15/320 |
| 6,243,917 | B1 * | 6/2001 | Conrad | 15/372 |
| 6,530,106 | B1 * | 3/2003 | Brundula | 15/182 |
| 6,536,071 | B2 * | 3/2003 | Zahuranec et al. | 15/320 |
| 6,662,402 | B2 * | 12/2003 | Giddings et al. | 15/320 |

* cited by examiner

*Primary Examiner*—Theresa T. Snider
(74) *Attorney, Agent, or Firm*—McGarry Bair PC

(57) ABSTRACT

An extraction cleaning machine has a solution dispensing system and a recovery system for applying a cleaning solution to a surface and recovering the solution from the surface, and an agitation brush assembly for agitating the surface. The agitation brush assembly can include friction-type or other dampers for reducing brush bounce, and biasing elements for maintaining a constant downward force on the brush. The brush can have multiple helical rows of tufted bristles, preferably at least four rows, or can comprise a continuous helix of bristles in a twisted-wire spindle. The brush can further have a removable fabric cover for mounting over a bristle brush for contacting a surface being cleaned. The brush assembly can function in an upright extraction cleaning machine with or without an above floor cleaning tool, a hand-held extractor, or a hand-held attachment to a canister extractor or an above floor tool in upright extractor.

18 Claims, 10 Drawing Sheets

EXTRACTION CLEANING MACHINE WITH AGITATION BRUSHES

CROSS REFERENCE TO RELATED APPLICATIONS

This application claims the benefit of U.S. Provisional Application No. 60/302,526, filed Jul. 2, 2001

BACKGROUND OF INVENTION

1. Field of the Invention

The invention relates to extraction cleaning machines incorporating agitation brushes. In one of its aspects, the invention relates to an extraction cleaning machine incorporating a multi-row agitation brush. In another of its aspects, the invention relates to extraction cleaning machines incorporating a twist-wire agitation brush. In yet another of its aspects, the invention relates to extraction cleaning machines incorporating an agitation brush dampening mechanism. In yet another of its aspects, the invention relates to an extraction cleaning machines incorporating an agitation brush that applies a predetermined force to a carpet.

2. Description of Related Art

Extraction cleaning machines are used for removing dirt from surfaces such as carpeting, upholstery, drapes and the like. Known extraction cleaning machines can be in the form of a canister-type unit as disclosed in U.S. Pat. No. 5,237,720 to Blase et al.; an upright unit as disclosed in U.S. Pat. No. 6,134,744 to Kasen et al. and U.S. Pat. No. 6,167,587 to Kasper et al.; and a hand-held unit as disclosed in U.S. Pat. No. 5,367,740 to McCray.

Vacuum cleaning machines are also used for removing dirt from surfaces. Vacuum cleaning machines have rotating brushes to agitate the surface, thus enhancing cleaning effectiveness. Brushes can be in the form of multiple rows of bristles as disclosed in U.S. Pat. No. 2,659,921 to Osborn, and twist-wire type bristles in U.S. Pat. No. 1,205,162 to Clements.

SUMMARY OF INVENTION

An extraction cleaning machine has a housing with a solution dispensing system and a solution recovery system mounted thereto for applying a cleaning solution to a surface being cleaned and recovering the solution from the surface, and an agitation brush for agitation of the surface being cleaned. A drive motor is mounted in the housing and is connected to the agitation brush for rotation of the elongated agitation brush about the longitudinal axis.

In one embodiment, the elongated agitation brush is selected from a multi-row, helically arranged bristle brush and a helically arranged twisted wire brush. The helically arranged bristle brush has at least four rows of bristles. The helically arranged twist wire brush comprises a continuous helical array of radially extending bristles bound by a pair of twisted wires forming a spindle.

In another embodiment, the elongated agitation brush is mounted to the housing through a pair of arms which are pivotally attached at one end to the housing and rotatably support the elongated brush roll at another end thereof. A spring is mounted between the arms and the housing to bias the elongated brush roll with respect to the housing into contact with the surface to be cleaned. In a preferred embodiment, at least one of the arms has a resiliently mounted projection which against a surface of the housing to resist transient vibrations of the elongated agitation brush with respect to the housing. The resiliently mounted projection is mounted on an integrally formed flexible tab on the at least one arm.

In another embodiment, a torsional spring provides a rotational bias about pivot pins located on brush arms to force the agitation brush toward the surface to be cleaned. In alternate embodiments, downward force of the brush can also be accomplished with a compression spring or cantilever beam spring mounted between the brush arm and the base housing.

In another embodiment, a cover encircles the elongated agitation brush and is removably mounted thereto for contacting the surface to be cleaned. Desirably, the elongated cover is a fabric and is secured onto the elongated agitation brush with a hook and pile fastener.

In one embodiment, the housing is a hand held deep cleaner housing. In another embodiment, the housing comprises a base including a pair of wheels for movement along a surface to be cleaned, and further includes a handle pivotally mounted to the base for manipulation of the base along a floor surface to be cleaned. In yet another embodiment, the working air conduit includes a flexible hose which is joined at one end to the housing and further comprising a hand tool mounted to a free end of the flexible hose, and the suction nozzle and the elongated agitation brush are mounted in the hand tool. In this embodiment, a turbine motor can be mounted in the hand tool to drive the agitation brush.

Testing has shown that extraction type cleaning in combination with the brush configurations described herein provide an unexpected improvement in cleaning performance when compared to extraction cleaners with other types of agitation brushes.

DETAILED DESCRIPTION

Figure 1:
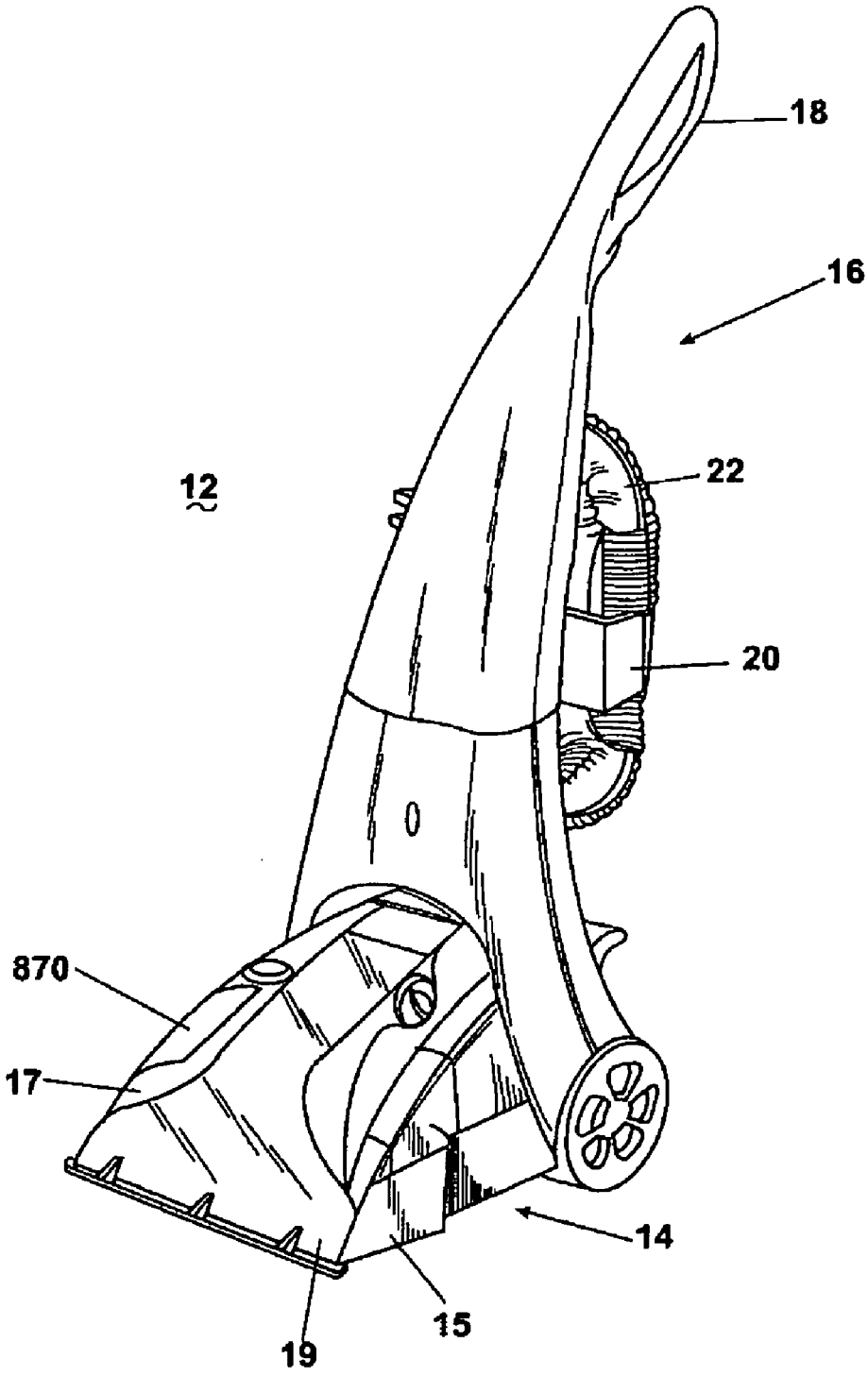
FIG. 1 is a perspective view of an extraction cleaning machine according to the invention.

Referring now to the drawings and to FIG. 1 in particular, an upright extraction cleaning machine 12 according to the invention is shown. The machine 12 is a portable surface cleaning apparatus including a base module 14 adapted to roll across a surface to be cleaned and an upright handle assembly 16 pivotally mounted to a portion of the base module 14.

Figure 2:
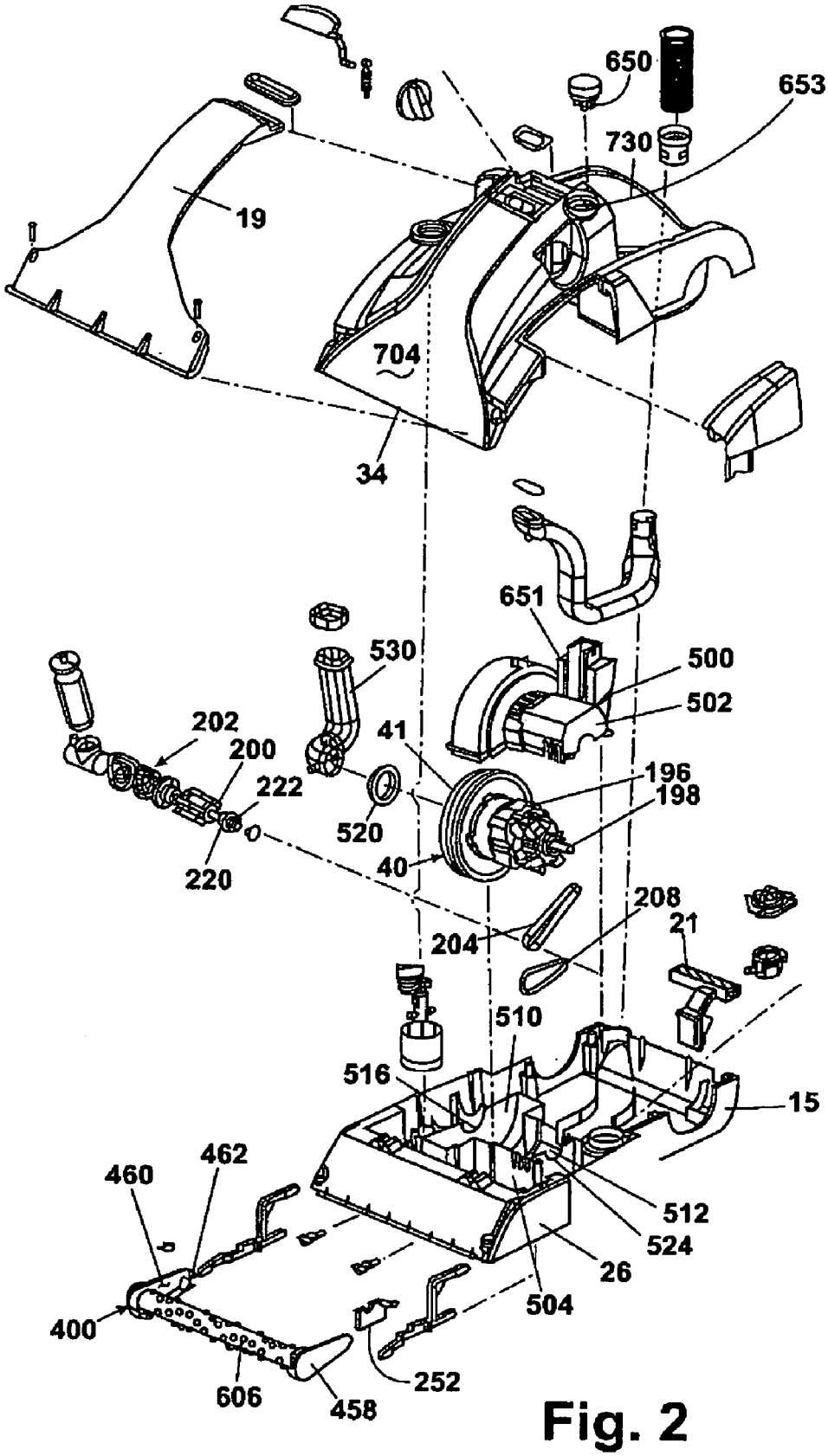
FIG. 2 is an exploded view of a base module of the extraction cleaning machine shown in FIG. 1.
Figure 3:
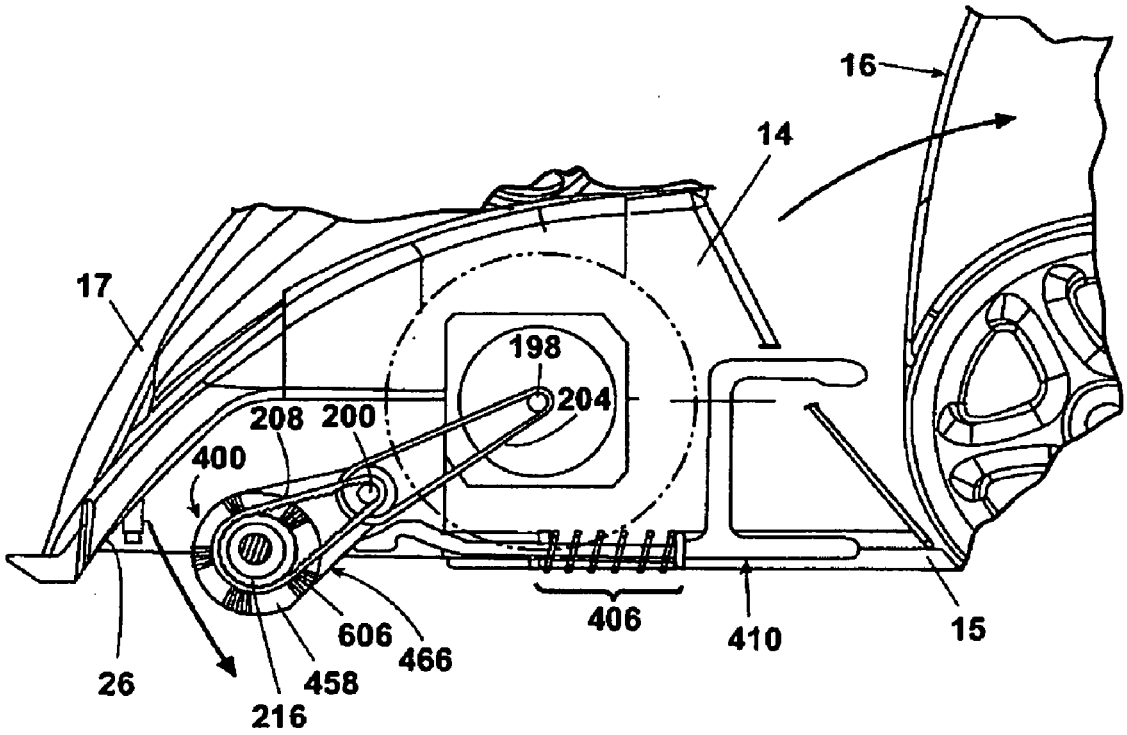
FIG. 3 is a partial sectional side view of the foot module of the extraction cleaning machine of FIG. 1.

As best shown in FIGS. 1–3, the base module 14 includes a lower housing portion 15 and an upper housing portion 17, which together define an interior for housing components and a well 730 for receiving a tank assembly (not shown). The upper housing portion 17 receives a transparent facing 19 for defining a first working air conduit 704 and a suction nozzle 34, which is disposed at a front portion of the base module 14 adjacent the surface being cleaned for recovering fluid therefrom. The handle assembly 16 has a closed loop grip 18 provided at the uppermost portion thereof and a combination hose and cord wrap 20 that is adapted to support an accessory hose 22 and a electrical cord (not shown) when either is not in use. A latch assembly 21 is pivotally mounted to the rear portion of the base module 14 adjacent the rotational union of the handle assembly 16 therewith for releasably locking the handle assembly 16 in its upright position.

As shown in FIG. 2, the base module 14 houses a drive motor 196 that is connected to a source of electricity by the electrical cord. A motor compartment 500 within the base module 14 is a clamshell-shaped housing for holding a motor assembly in place and preventing rotation thereof. The clamshell motor compartment 500 includes an upper half 502 and a lower half 504. The upper half 502 is removable from the lower half 504, which is integral to the extraction cleaner base module 14. Thus, a bottom wall of the lower half 504 is the bottom surface of the extraction cleaner base module 14. An arm 651 extends upwardly from the motor housing 500 in the base module 14 to support the flow indicator 650, which is mounted to an upper end thereof. An opening 653 in the upper housing portion 17 receives the flow indicator 650 when that portion is mounted to the lower housing portion 15.

The motor compartment 500 includes a large circular impeller fan housing 510 and a smaller motor housing 512, further having a generally T-shaped cross section. The impeller fan housing 510 surrounds an inner housing 41 defining a vacuum source 40, which is created preferably by an impeller (not shown) disposed within the housing 41. The housing 41 includes a large aperture 516 for mounting a vacuum intake duct 530, which is sealed to the aperture 516 by a gasket 520. The smaller motor housing 512 includes a small aperture 524 for receiving therethrough a motor drive shaft 198. A stretch belt 204 is received on the motor drive shaft 198 outside of the clamshell motor compartment 500.

Figure 6:
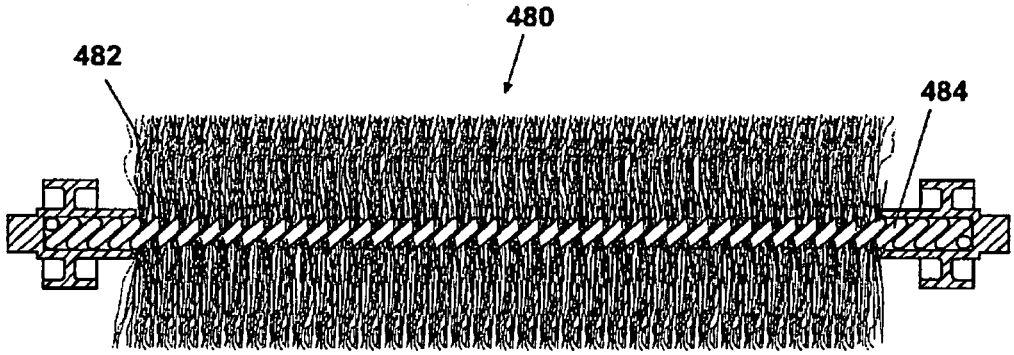
FIG. 6 is a partial cross-sectional view of another embodiment of a twist-wire brush according to the invention.
Figure 5:
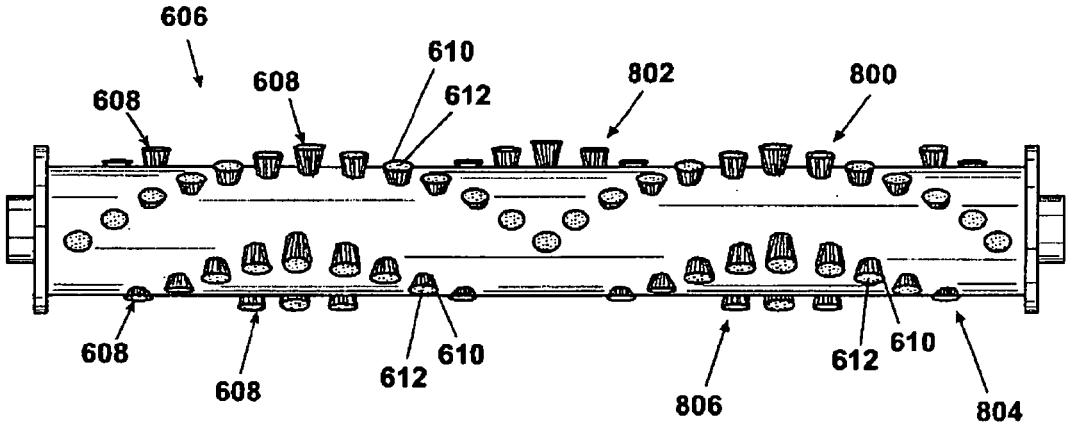
FIG. 5 is a front view of an agitation brush according to the invention.

The drive shaft 198 of the drive motor 196 is connected to an interim drive shaft 200 of a solution pump 202 by the stretch belt 204, which in turn, is connected to a rotatably mounted agitation brush 606 by a timing belt 208, as best illustrated in FIGS. 5 and 6. On the opposite side of the motor 196, the motor drive shaft 198 supports the impeller (not shown) within the impeller housing 41, which provides the vacuum source 40 and is mounted inside the housing 510 of the motor compartment 500. With this configuration, a single drive motor 196 is adapted to provide driving force for the impeller, the solution pump 202, and the agitation brush 606.

Figure 4:
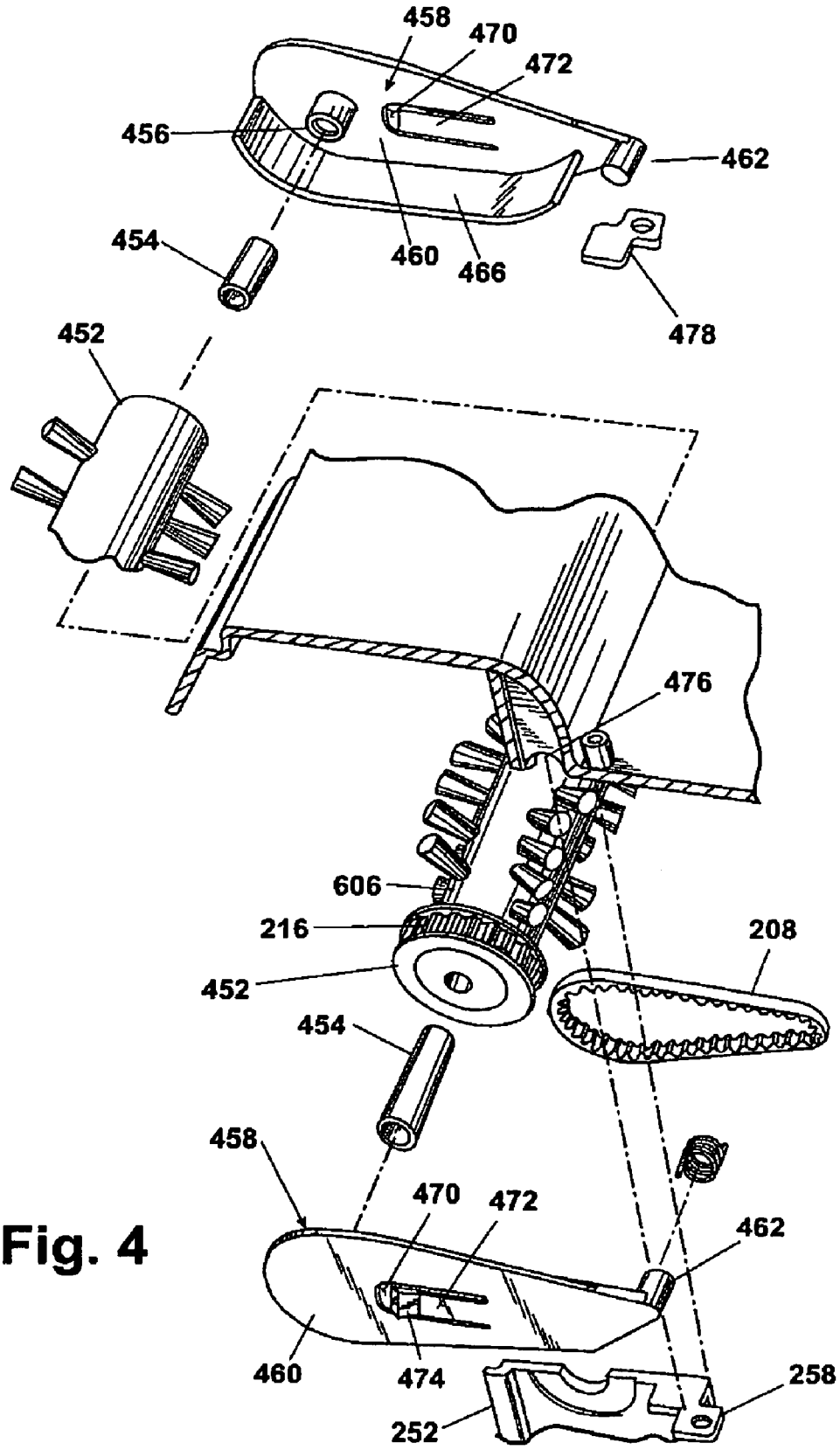
FIG. 4 is an exploded view of a floating brush assembly for the extraction cleaning machine of FIG. 1.

As best seen in FIGS. 2, 3, and 4, the rotatably mounted agitation brush 606 is adapted for floor-responsive adjustment by a floating brush assembly 400 mounted within an agitation brush housing 26 disposed within a forward portion of the base module 14. The floating movement of the agitation brush 606 is a horizontally oriented arcuate path for reciprocation toward and outward of the agitation brush housing 26. Ends 452 of an agitation brush shaft 606 are received in bearings 454, which in turn, are press fit into inwardly extending bosses 456 to provide a pair of opposed articulating arm members 458. Alternatively, stub shafts (not shown) can extend from the arm members 458 and the ends 452 can be replaced with bearings similar to 454 for rotational installation of the brush 606 on the arm members 458.

Each arm member 458 comprises a back plate 460 with a pivot pin 462 provided at the rear of the plate 460. In addition, a laterally extending belt guard 466 is preferably integrally formed with the articulating arm 458. The belt guard 466, which extends laterally inwardly enough to cover the timing belt 208, minimizes the lodging of threads and other foreign material in the timing belt 208 and protects the carpet or other surface positioned below the base assembly 14 from the rotating belt 208.

As best shown in FIGS. 3 and 4, the timing belt 208 is reeved through a pulley 216 mounted at one end of the brush 606 and a pulley 222 on the interim drive shaft 200 of the pump 202, which includes a separate pulley 220 through which is reeved the stretch belt 204, which, in turn, extends around the drive shaft 198 of the motor 196. Further, the pulley 220 has a convex cross section of its periphery, whereby it is adapted to receive the smooth stretch belt 204, while the pulley 222 has a toothed perimeter adapted for registration with the teeth in the timing belt 208.

The pivot pins 462 of the arm member 458 are rotatably supported secured in a bearing (not shown) mount integrally formed with an internal wall of the agitation brush housing 26. Further, the pivot pins 462 are held in the bearing by a support 478 on the non-belt side of the base module 14 and the arm 258 of the second belt access door 252 on the belt side of the base module. Both the arm 258 and support 478 are secured to the agitation brush housing 26 by a conventional fastener (not shown) inserted through an aperture in each part. The arm members 458 are preferably limited in their downward movement relative to the agitation brush housing 26 by the length of the timing belt 208 as well as the engagement of the brush guards 466 with the arm 258 and the support 478. As the floating brush assembly 400 extends further and further downwardly, the belt 208 will stretch and resist further downward movement. Eventually, the brush guards 466 on each arm 458 will contact respectively the arm 258 and the support 478, which prevents any further downward movement.

With this floating agitation brush assembly 400, the cleaning machine 12 according to the invention can almost instantaneously adapt to varying carpet naps or other inconsistencies on the surface being cleaned. The arm members 458 also allow the rotating brush 606 to drop below the normal floor plane to, for example, provide contact with a bare floor.

The upright extraction cleaning machine described above is disclosed in more detail in U.S. Pat. No. 6,167,587, which is incorporated herein by reference in its entirety.

Referring now to FIG. 4, arm member 458 includes a U-shaped slot 470 defining an integral resilient tab 472. Resilient tab 472 includes a friction projection 474 extending from outer face of plate 460. The plate 460 maintains a tight tolerance with the sidewall of the base module, such that friction projection 474 resiliently bears against the sidewall of the base module under the influence of resilient tab 472. In this manner, the friction projection 474 resists transient vibrations of the agitation brush assembly such as brush "bounce" caused by contact of the brush assembly with an uneven floor surface.

Referring to FIGS. 3 and 4, a torsion spring 476 is illustrated for mounting on pivot pins 462 to provide a rotational bias about pivot pins 462 to direct agitation brush 606 toward the surface being cleaned. In lieu of the torsion spring 476, a forward ramped surface 414 of an elevator assembly 410 can be attached to a rearward portion of arm member 458. Compression spring assembly 406 biases the elevator assembly 410 rearward relative to the base housing. In operation, when the upright handle 16 is placed in the upright position, the elevator assembly 410 is moved forward compressing the spring assembly 406 and lifting the arm member 458. When the upright handle 16 is lowered, the spring assembly 406 forces the elevator assembly 410 rearward, pulling the arm member 458 with it, therefore biasing the brush 458 against the surface to be cleaned. The operation of the elevator assembly 410 is described more completely in U.S. Pat. No. 6,167,587 which is incorporated herein by reference in its entirety. In the alternative, it is anticipated that a compression spring situated between the brush housing and the arm member 458, at an end of arm member 458 distal from pivot pins 462, can provide the same downward bias to the agitation brush 606. Likewise, a cantilever beam spring mounted to one of the arm member 458 and the brush housing and bearing against the other of the arm member 458 and the brush housing can provide a downward bias to the agitation brush 606. A downward bias can also be accomplished by increasing the weight of the brush 606 to reduce its susceptibility to bounce or float away from the surface being cleaned, thus improving cleaning performance.

Referring to FIG. 5, the agitation brush 606 comprises multiple rows 608 of bristles 610 formed in tufts 612. The increase in the number and density of bristles on the surface of the agitation brush has been found to increase the cleaning effectiveness of the brush 606. In the illustrated embodiment, there are four rows 800, 802, 804, 806 of bristles in a generally longitudinally sinusoidal configuration. The number of rows 608 of bristles can vary depending on the function of the machine. We have discovered that at least three rows of bristles 608 has surprisingly enhanced cleaning compared with a single or even a double row of bristles. Typically, there will be 4–6 rows 608 of bristles, preferably five rows.

Referring now to FIG. 6, a further embodiment of a twist-wire agitation brush 480 is shown comprising an array of continuous helical bristles 482 bound by a twist-wire spindle 484. The twist-wire spindle 484 provides the advantage of a flexible brush 480 for conformance to the surface being cleaned and therefore equalization of the brushing force applied to the surface. The twist-wire agitation brush 480 also has the advantage of being lighter in weight, requiring lighter weight support structure and a less powerful brush drive motor. Especially in combination with the spring bias feature illustrated in FIG. 4, the twist-wire brush 480 has the advantage of lower weight and better conformance to the surface being cleaned while maintaining firm contact to effectively clean the surface. The twist-wire spindle 484 can be formed of material such as galvanized steel, aluminum or stainless steel, the material selected in order to ensure compatibility with the preferred cleaning compounds for the application.

Figure 11:
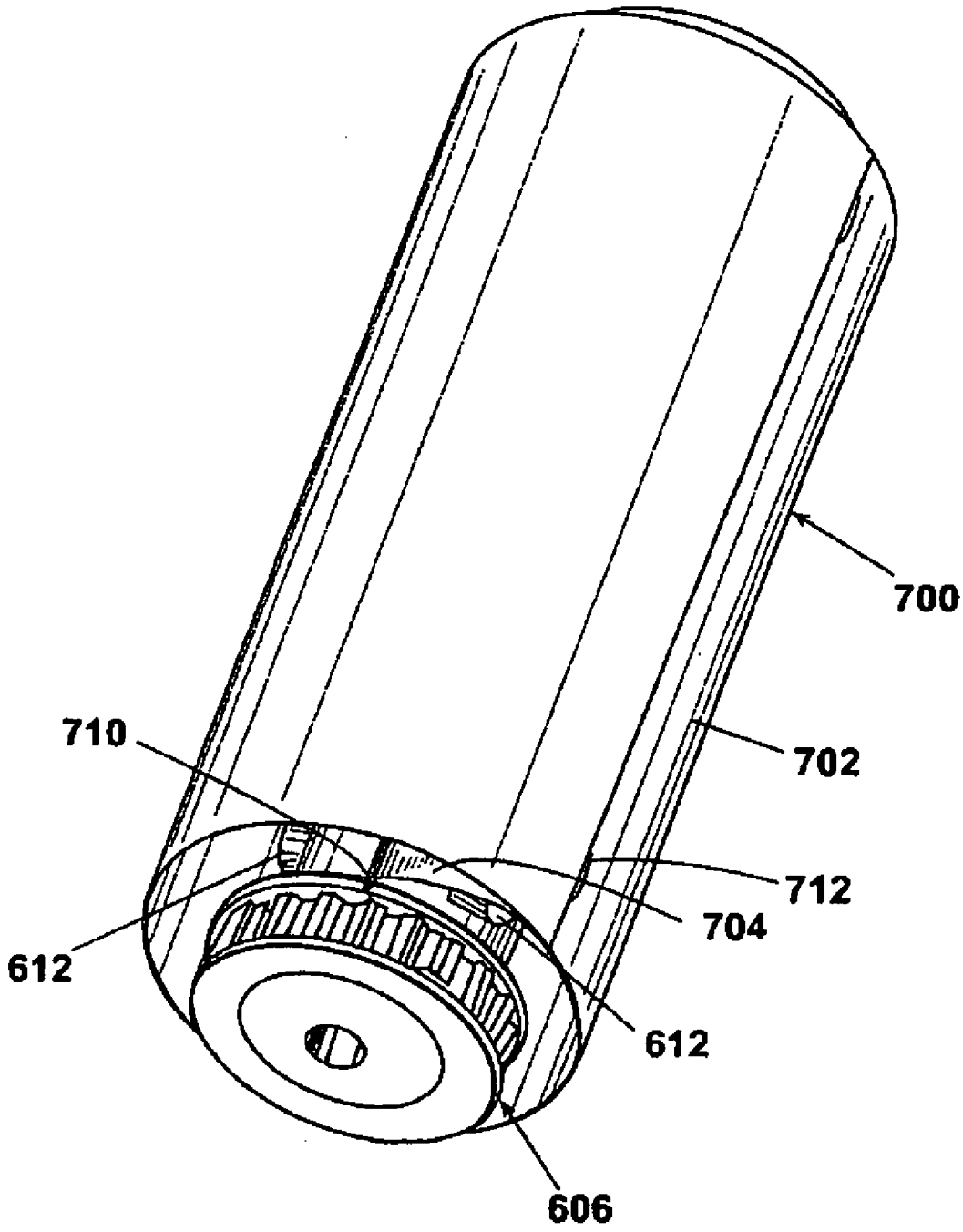
FIG. 11 is a perspective view of an agitation brush including a removable cover according to the invention.

Referring to FIG. 11, a further embodiment of an agitation brush according to the invention includes a removable/replaceable fabric cover 700 secured about multi-row bristle brush 606. The fabric cover has an outer surface 702 for contacting a surface being cleaned. The fabric cover 700 is secured at a first end 704 to the brush roll by way of a slot or fastener 710 and wrapped firmly about the outside diameter of the rows of bristles 608 until it laps over itself and is secured by known fasteners 712 such as hooks, snaps, buttons or hook-and-loop fasteners. The fabric cover 700 can be formed of any one of a number of cloth or textile materials such as terry cloth, corduroy or other materials of varying porosity or surface texture. The fabric cover 700 is easily removable for cleaning or replacement. The fabric cover 700 can be fabricated to be reversible as a given side becomes dirty or worn, or with each side having a different texture. Fabric covers have been shown to provide cleaning advantages in some applications, but can become dirty or wear out quickly, requiring a ready method of removal and replacement.

Figure 7:
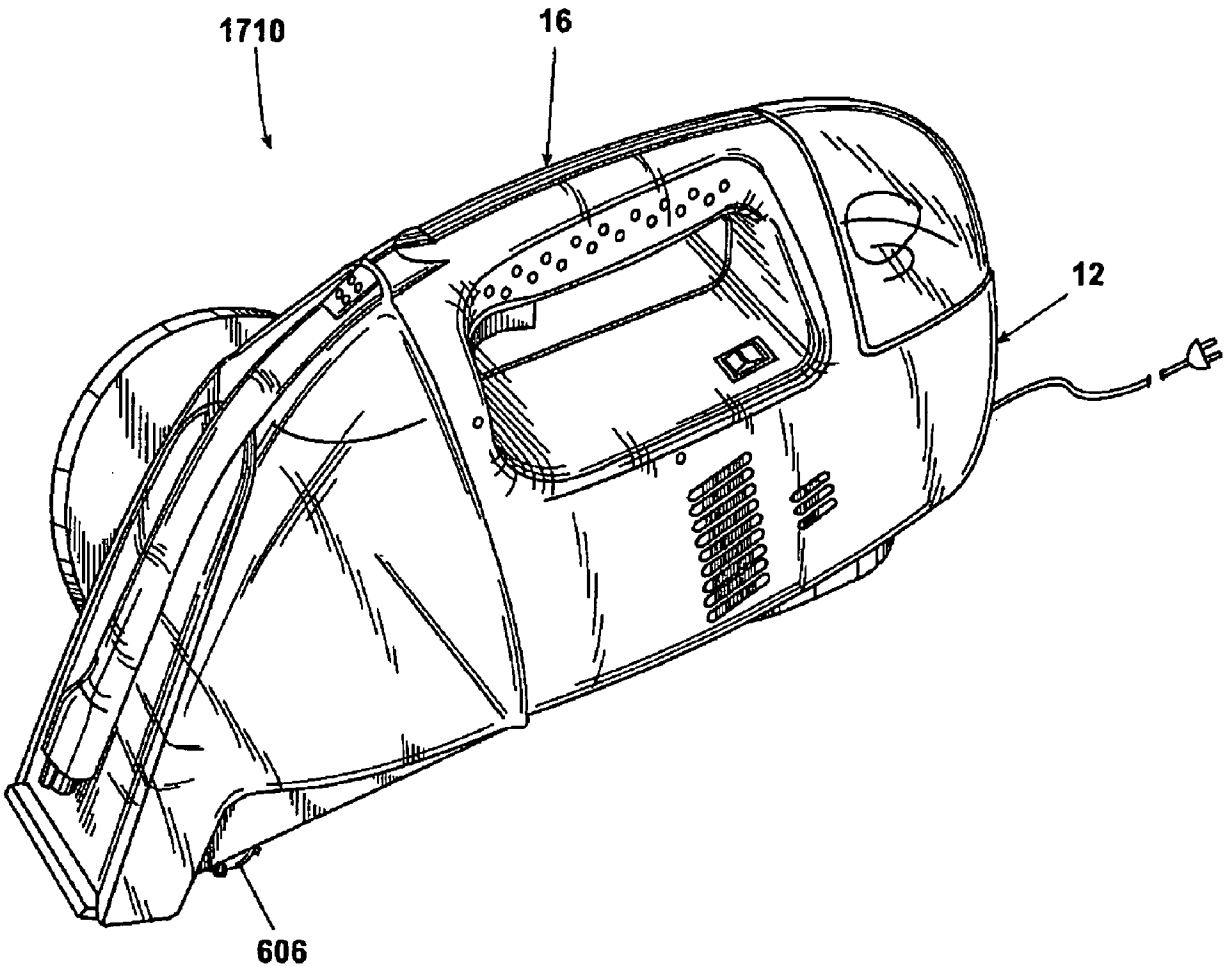
FIG. 7 is a perspective view of a further embodiment of an extraction cleaning machine according to the invention.
Figure 8:
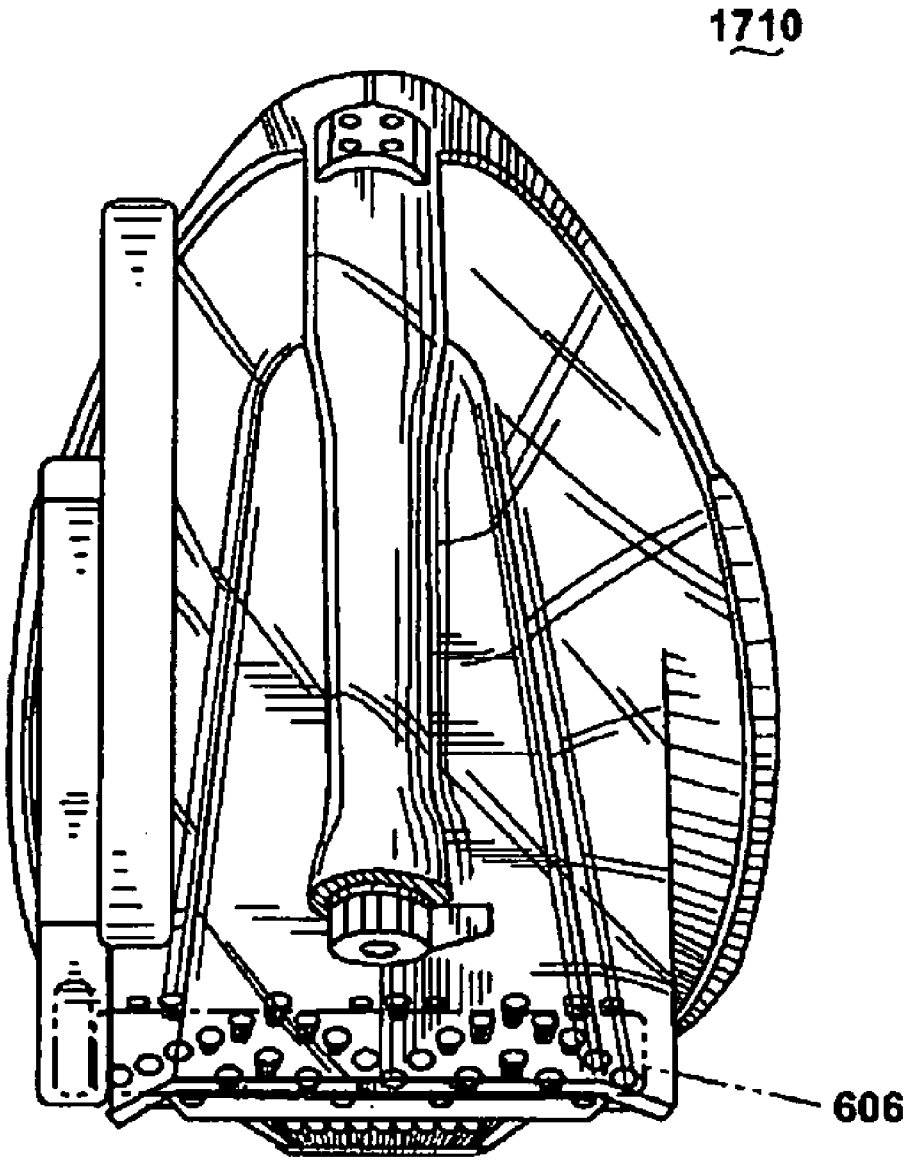
FIG. 8 is a front view of the extraction cleaning machine of FIG. 7.

A further application of the twist-wire brush 480 of FIG. 6, the agitation brush 606 with multiple rows 608 of FIG. 5, and fabric cover 700 of FIG. 11 is in a hand-held extraction cleaner, as shown in FIGS. 7 and 8. It is anticipated that the twist-wire brush 480, the agitation brush 606, or the fabric cover 700 can be used in the hand-held extraction cleaner 1710. Those features of the hand-held extraction cleaner 1710 shown in the figures but not further discussed herein are described in U.S. Provisional Application Ser. No. 60/239,670, filed Oct. 12, 2000 and U.S. Pat. No. 6,125,498 issued Oct. 3, 2000, all of which are incorporated herein by reference in their entirety.

Figure 9:
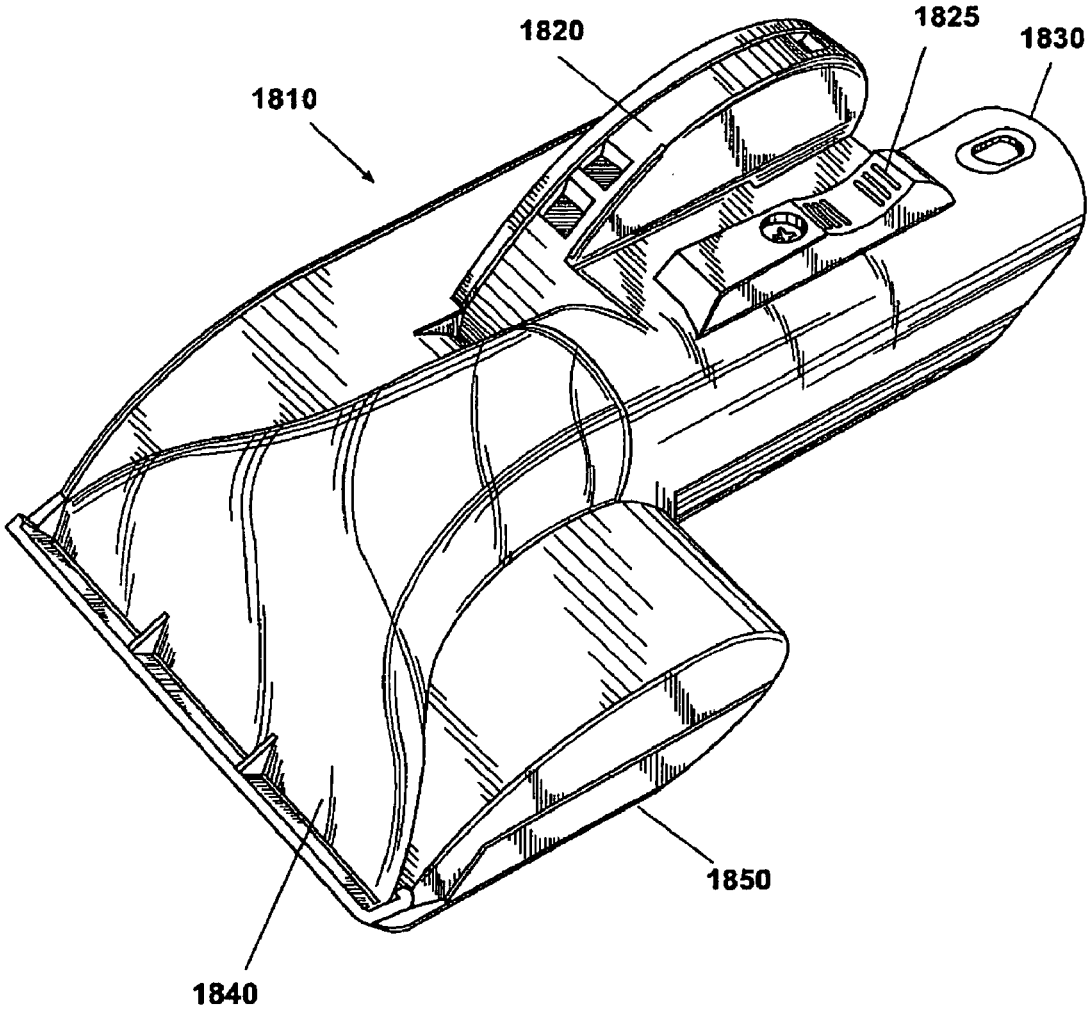
FIG. 9 is a perspective view of a hand-held attachment for an extraction cleaning machine according to the invention.
Figure 10:
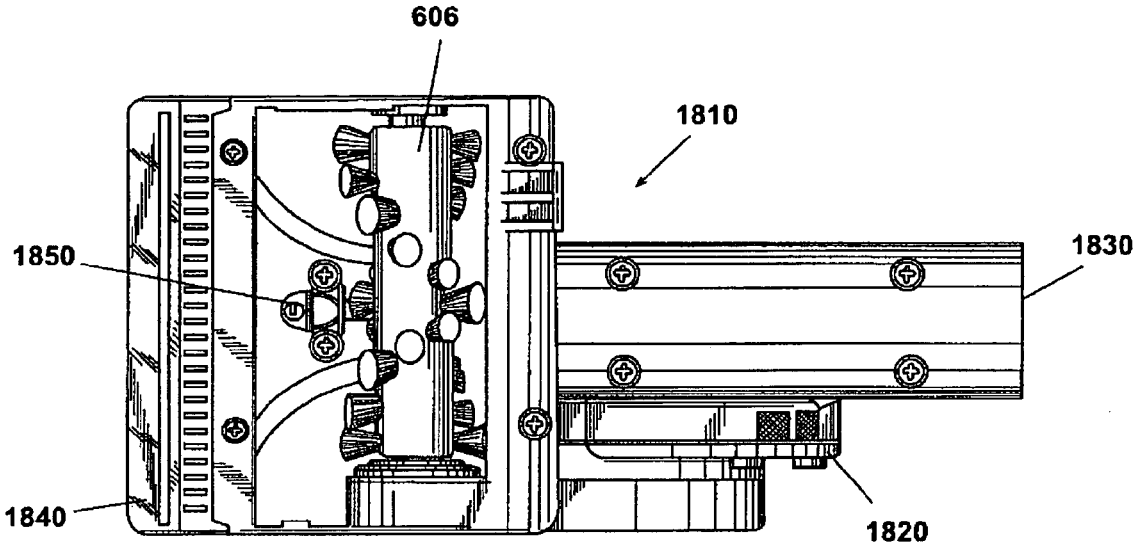
FIG. 10 is a bottom view of the hand-held attachment of FIG. 9 showing an agitation brush.

A further application of the twist-wire brush 480 of FIG. 6, the agitation brush with multiple rows 608 of FIG. 5, and fabric cover 700 of FIG. 11 is in a hand-held attachment 1810 for an extraction cleaner, as shown in FIGS. 9 and 10. The hand-held attachment 1810 attaches at a first end 1830 to a hose (not shown) fluidly connected to an extraction cleaner such as a canister extraction cleaner or an upper right extraction cleaner, the hose including a suction conduit and a fluid supply conduit. The suction conduit is selectively fluidly connected to a suction nozzle 1840 or to a turbine 1820 for driving an agitation brush 606, the attachment 1810 including a selector slide 1825 for directing the suction air flow to the turbine 1820 or suction nozzle 1840. The fluid supply conduit is fluidly connected to a spray nozzle 1850. It anticipated that the twist-wire brush 480 can be used in place of the agitation brush 606 in the hand-held attachment 1810.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

What is claimed is:

1. An extraction surface cleaning apparatus having;

a housing with a fluid dispensing system and a fluid recovery system mounted thereto;

the fluid dispensing system including:

a fluid dispenser for applying fluid to a surface to be cleaned;

a fluid supply chamber for holding a supply of cleaning fluid;

a fluid supply conduit fluidly connected to the fluid supply chamber and to the fluid dispenser for supplying fluid to the dispenser;

the fluid recovery system including:

a recovery chamber for holding recovered fluid;

a suction nozzle;

a working air conduit extending between the recovery chamber and the suction nozzle; and a vacuum source in fluid communication with the recovery chamber for generating a flow of working air from the suction nozzle through the working air conduit and to the recovery chamber to thereby draw dirty fluid from the surface to be cleaned through the suction nozzle and the working air conduit, and into the recovery chamber;

an elongated agitation brush mounted to the housing adjacent to the suction nozzle for rotation about a longitudinal axis; and a drive motor mounted in the housing and connected to the agitation brush for rotation of the elongated agitation brush about the longitudinal axis;

the improvement which comprises:

the elongated agitation brush is mounted to the housing through a pair of arms which are pivotally attached at a first end to the housing and rotatably support the elongated agitation brush at a second end thereof; and a spring connected at one end to the first end of one of the arms and at another end to the housing to bias the elongated agitation brush with respect to the housing into contact with the surface to be cleaned.

2. The extraction surface cleaning apparatus according to claim 1 wherein the elongated agitation brush is selected from a multi-row, sinusoidally arranged bristle brush and a helically arranged twisted wire brush.

3. The extraction surface cleaning apparatus according to claim 2 wherein the sinusoidally arranged bristle brush has at least four rows of bristles.

4. The extraction surface cleaning apparatus according to claim 2 wherein the helically arranged twist wire brush comprises a continuous helical array of radially extending bristles bound by a pair of twisted wires forming a spindle.

5. The extraction surface cleaner apparatus according to claim 2 wherein the housing is a hand held deep cleaner housing.

6. The extraction surface cleaning apparatus according to claim 2 wherein the housing comprises a base including a pair of wheels for movement along the surface to be cleaned, and further includes a handle pivotally mounted to the base for manipulation of the base along the surface to be cleaned.

7. The extraction surface cleaning apparatus according to claim 2 wherein the working air conduit includes a flexible hose which is joined at one end to the housing and further comprising a hand tool mounted to a free end of the hose and the suction nozzle and the elongated agitation brush are mounted in the hand tool.

8. The extraction surface cleaning apparatus according to claim 7 wherein the drive motor is a turbine motor mounted in the hand tool.

9. An extraction surface cleaning apparatus having;

a housing with a fluid dispensing system and a fluid recovery system mounted thereto;

the fluid dispensing system including:

a fluid dispenser for applying fluid to a surface to be cleaned;

a fluid supply chamber for holding a supply of cleaning fluid;

a fluid supply conduit fluidly connected to the fluid supply chamber and to the fluid dispenser for supplying fluid to the dispenser, the fluid recovery system including:

a recovery chamber for holding recovered fluid;

a suction nozzle;

a working air conduit extending between the recovery chamber and the suction nozzle; and a vacuum source in fluid communication with the recovery chamber for generating a flow of working air from the suction nozzle through the working air conduit and to the recovery chamber to thereby draw dirty fluid from the surface to be cleaned through the suction nozzle and the working air conduit, and into the recovery chamber;

an elongated agitation brush mounted to the housing adjacent to the suction nozzle for rotation about a longitudinal axis; and a drive motor mounted in the housing and connected to the agitation brush for rotation of the elongated agitation brush about the longitudinal axis;

the improvement which comprises:

a fabric cover encircling the elongated agitation brush and removably mounted thereto for contacting the surface to be cleaned.

10. The extraction surface cleaning apparatus according to claim 9 wherein the elongated cover is a fabric and is secured onto the elongated agitation brush with a hook and pile fastener.

11. An extraction surface cleaning apparatus having;

a housing with a fluid dispensing system and a fluid recovery system mounted thereto;

the fluid dispensing system including:

a fluid dispenser for applying fluid to a surface to be cleaned;

a fluid supply chamber for holding a supply of cleaning fluid;

a fluid supply conduit fluidly connected to the fluid supply chamber and to the fluid dispenser for supplying fluid to the dispenser;

the fluid recovery system including:

a recovery chamber for holding recovered fluid;

a suction nozzle;

a working air conduit extending between the recovery chamber and the suction nozzle; and a vacuum source in fluid communication with the recovery chamber for generating a flow of working air from the suction nozzle through the working air conduit and to the recovery chamber to thereby draw dirty fluid from the surface to be cleaned through the suction nozzle and the working air conduit, and into the recovery chamber;

an elongated agitation brush mounted to the housing adjacent to the suction nozzle for rotation about a longitudinal axis and adapted to agitate the surface to be cleaned; and a drive motor mounted in the housing and connected to the agitation brush for rotation of the elongated agitation brush about the longitudinal axis;

the improvement which comprises:

the elongated agitation brush is mounted to the housing through a pair of arms which are pivotally attached at one end to the housing and rotatably support the elongated agitation brush at another end thereof; and at least one of the arms has a resiliently mounted projection which bears against a surface of the housing to resist transient vibrations of the elongated agitation brush with respect to the housing.

12. The extraction surface cleaning apparatus according to claim 11 wherein the resiliently mounted projection is mounted on an integrally formed flexible tab on the at least one arm.

13. An extraction surface cleaning apparatus having;

a housing with a fluid dispensing system and a fluid recovery system mounted thereto;

the fluid dispensing system including:

a fluid dispenser for applying fluid to the surface to be cleaned;

a fluid supply chamber for holding a supply of cleaning fluid;

a fluid supply conduit fluidly connected to the fluid supply chamber and to the fluid dispenser for supplying fluid to the dispenser;

the fluid recovery system including:

a recovery chamber for holding recovered fluid;

a suction nozzle;

a working air conduit extending between the recovery chamber and the suction nozzle; and a vacuum source in fluid communication with the recovery chamber for generating a flow of working air from the suction nozzle through the working air conduit and to the recovery chamber to thereby draw dirty fluid from the surface to be cleaned through the suction nozzle and the working air conduit, and into the recovery chamber;

an elongated agitation brush mounted to the housing adjacent to the suction nozzle for rotation about a longitudinal axis and adapted to agitate the surface to be cleaned; and a drive motor mounted in the housing and connected to the agitation brush for rotation of the elongated agitation brush about the longitudinal axis;

the improvement which comprises:

the elongated agitation brush is selected from a multi-row, sinusoidally arranged bristle brush and a helically arranged twisted wire brush;

the elongated agitation brush is mounted to the housing through a pair of arms which are pivotally attached at one end to the housing and rotatably support the elongated agitation brush at another end thereof;

a spring between the arms and the housing biases the elongated agitation brush with respect to the housing into contact with the surface to be cleaned; and at least one of the arms has a resiliently mounted projection which bears against a surface of the housing to resist transient vibrations of the elongated agitation brush with respect to the housing.

14. The extraction surface cleaning apparatus according to claim 13 wherein the resiliently mounted projection is mounted on an integrally formed flexible tab on the at least one arm.

15. An extraction surface cleaning apparatus having;

a housing with a fluid dispensing system and a fluid recovery system mounted thereto;

the fluid dispensing system including:

a fluid dispenser for applying fluid to the surface to be cleaned;

a fluid supply chamber for holding a supply of cleaning fluid;

a fluid supply conduit fluidly connected to the fluid supply chamber and to the fluid dispenser for supplying fluid to the dispenser;

the fluid recovery system including:

a recovery chamber for holding recovered fluid;

a suction nozzle;

a working air conduit extending between the recovery chamber and the suction nozzle; and a vacuum source in fluid communication with the recovery chamber for generating a flow of working air from the suction nozzle through the working air conduit and to the recovery chamber to thereby draw dirty fluid from the surface to be cleaned through the suction nozzle and the working air conduit, and into the recovery chamber, an elongated agitation brush mounted to the housing adjacent to the suction nozzle for rotation about a longitudinal axis and adapted to agitate the surface to be cleaned; and a drive motor mounted in the housing and connected to the agitation brush for rotation of the elongated agitation brush about the longitudinal axis;

the improvement which comprises:

the elongated agitation brush is selected from a multi-row, sinusoidally arranged bristle brush and a helically arranged twisted wire brush; and further comprising a fabric cover encircling the elongated agitation brush and removably mounted thereto for contacting the surface to be cleaned.

16. The extraction surface cleaning apparatus according to claim 15 wherein the elongated cover is a fabric and is secured onto the elongated agitation brush with a hook and pile fastener.

17. An extraction surface cleaning apparatus having;

a housing with a fluid dispensing system and a fluid recovery system mounted thereto;

the fluid dispensing system including:

a fluid dispenser for applying fluid to a surface to be cleaned;

a fluid supply chamber for holding a supply of cleaning fluid;

a fluid supply conduit fluidly connected to the fluid supply chamber and to the fluid dispenser for supplying fluid to the dispenser;

the fluid recovery system including:

a recovery chamber for holding recovered fluid;

a suction nozzle;

a working air conduit extending between the recovery chamber and the suction nozzle; and a vacuum source in fluid communication with the recovery chamber for generating a flow of working air from the suction nozzle through the working air conduit and to the recovery chamber to thereby draw dirty fluid from the surface to be cleaned through the suction nozzle and the working air conduit, and into the recovery chamber;

an elongated agitation brush mounted to the housing adjacent to the suction nozzle for rotation about a longitudinal axis; and a drive motor mounted in the housing and connected to the agitation brush for rotation of the elongated agitation brush about the longitudinal axis;

the improvement which comprises:

the elongated agitation brush is mounted to the housing through a pair of arms which are pivotally attached at one end to the housing and rotatably support the elongated agitation brush at another end thereof;

a spring between the arms and the housing biases the elongated agitation brush with respect to the housing into contact with the surface to be cleaned; and at least one of the arms has a resiliently mounted projection which bears against a surface of the housing to resist transient vibrations of the elongated agitation brush with respect to the housing.

18. The extraction surface cleaning apparatus according to claim 17 wherein the resiliently mounted projection is mounted on an integrally formed flexible tab on the at least one arm.

* * * * *